US008262403B2

(12) United States Patent
Slippy et al.

(10) Patent No.: US 8,262,403 B2
(45) Date of Patent: Sep. 11, 2012

(54) BREAK-AWAY ELECTRICAL CONNECTOR

(75) Inventors: Gordon Slippy, Murrysville, PA (US); Donald E. Hines, Butler, PA (US); Charles Amurgis, Mars, PA (US); Jon J. Danzak, Pittsburgh, PA (US)

(73) Assignee: Vocollect, Inc., Pittsburgh, PA (US)

( * ) Notice: Subject to any disclaimer, the term of this patent is extended or adjusted under 35 U.S.C. 154(b) by 326 days.

(21) Appl. No.: 12/557,011

(22) Filed: Sep. 10, 2009

(65) Prior Publication Data

US 2011/0059642 A1 Mar. 10, 2011

(51) Int. Cl.
*H01R 13/627* (2006.01)

(52) U.S. Cl. ..... 439/353

(58) Field of Classification Search ..... 439/353, 439/638, 660, 357, 358, 180, 289, 700, 824, 439/822, 341, 376, 923
See application file for complete search history.

(56) References Cited

U.S. PATENT DOCUMENTS

| | | | |
|---|---|---|---|
| 1,753,317 | A | 4/1930 | Rothen |
| 2,170,287 | A | 8/1939 | Kinnebrew |
| 2,369,860 | A | 2/1945 | Schroeder |
| 2,741,194 | A | 4/1956 | Dorey |
| 3,363,214 | A | 1/1968 | Wright |
| 3,781,039 | A | 12/1973 | Edwards et al. |
| 3,786,397 | A | 1/1974 | Bridges |
| 3,808,577 | A | 4/1974 | Mathauser |
| 3,964,771 | A | 6/1976 | Baudouin |
| D240,433 | S | 7/1976 | Krapowicz |
| 4,068,913 | A | 1/1978 | Stanger |
| 4,189,620 | A | 2/1980 | Stange |
| 4,558,864 | A | 12/1985 | Medwedeff |
| 4,595,251 | A | 6/1986 | Moulin |
| 4,601,528 | A | 7/1986 | Spier |
| D285,439 | S | 9/1986 | Nagele |
| 4,619,491 | A | 10/1986 | Drogo |
| 4,620,760 | A | 11/1986 | Duncan |
| 4,649,332 | A | 3/1987 | Bell |
| 4,698,717 | A | 10/1987 | Scheid |

(Continued)

FOREIGN PATENT DOCUMENTS

DE 4111049 10/1991

(Continued)

OTHER PUBLICATIONS

C:\Documents and Settings\Idaniel\Application Data\LexisNexis\PatentOptimizer\temp\idsAnswer.xml.

(Continued)

*Primary Examiner* — Edwin A. Leon
(74) *Attorney, Agent, or Firm* — Wood, Herron & Evans, LLP

(57) ABSTRACT

An electrical connector for electrically connecting a terminal to a cord of a peripheral device, the electrical connector including a plug member, a lever arm pivotally attached to the plug member, and a biasing member. The plug member and lever arm each include an engagement claw adapted to engage complementary surfaces on the terminal, and the biasing member imparts a biasing force on the lever arm to force the engagement claws to close onto the complementary surfaces on the terminal. The lever arm advantageously includes a first gripping surface with a contoured concave profile for a user to apply a releasing force against the biasing force to remove the plug member from the terminal. A second surface includes a concave surface for engaging a user's finger and forming a grip bump.

18 Claims, 8 Drawing Sheets

U.S. PATENT DOCUMENTS 4,846,714 A 7/1989 Welsby
4,874,316 A 10/1989 Kamon et al.
D310,367 S 9/1990 Dockery
5,024,604 A 6/1991 Savin
5,052,943 A 10/1991 Davis
5,186,647 A 2/1993 Denkmann et al.
5,187,645 A 2/1993 Spalding et al.
D336,417 S 6/1993 Yuen
5,269,708 A 12/1993 DeYoung
5,299,956 A 4/1994 Brownell
5,310,363 A 5/1994 Brownell
5,326,284 A 7/1994 Bohbot
5,341,419 A 8/1994 Ferry
5,346,406 A 9/1994 Hoffman
5,362,257 A 11/1994 Neal et al.
5,371,679 A 12/1994 Abe et al.
5,393,239 A 2/1995 Ursich
5,399,102 A 3/1995 Devine
5,399,107 A 3/1995 Gentry
5,414,393 A 5/1995 Rose
5,432,484 A 7/1995 Klas
5,456,611 A 10/1995 Henry
5,462,452 A 10/1995 Devine
5,478,252 A 12/1995 Lecomte
5,480,313 A 1/1996 D'Alayer de Costemore d'Arc
D368,260 S 3/1996 Oschmann
5,501,571 A 3/1996 Van Durrett et al.
5,513,065 A 4/1996 Caveney et al.
5,517,683 A 5/1996 Collett
5,547,405 A 8/1996 Pinney
5,586,914 A 12/1996 Foster
5,599,209 A 2/1997 Belopolsky
5,618,185 A 4/1997 Aekins
5,639,256 A 6/1997 Endo et al.
5,647,770 A 7/1997 Belopolsky
5,657,459 A 8/1997 Yanagisawa et al.
5,665,485 A 9/1997 Kuwayama et al.
5,674,093 A 10/1997 Vaden
5,675,682 A 10/1997 De Marchi
5,687,478 A 11/1997 Belopolsky
5,697,817 A 12/1997 Bouchan
D391,937 S 3/1998 Rosen
5,759,070 A 6/1998 Belopolsky
5,779,503 A 7/1998 Tremblay et al.
5,803,750 A 9/1998 Purington et al.
5,864,089 A 1/1999 Rainal
D411,171 S 6/1999 Tai Muan
5,911,602 A 6/1999 Vaden
5,913,702 A 6/1999 Garcin
5,931,703 A 8/1999 Aekins
5,934,911 A 8/1999 Stout et al.
5,938,479 A 8/1999 Paulson
5,941,726 A 8/1999 Koegel
5,941,729 A 8/1999 Sri-Jayantha
5,984,709 A 11/1999 Zink et al.
5,993,246 A 11/1999 Moldenhauer
D420,325 S 2/2000 Sloey
6,022,237 A 2/2000 Esh
6,023,200 A 2/2000 Rhee
6,062,891 A 5/2000 Villiers
D426,190 S 6/2000 Higgins
6,086,428 A 7/2000 Pharney et al.
6,089,923 A 7/2000 Phommachanh
6,120,329 A 9/2000 Steinman
6,149,451 A 11/2000 Weber
6,155,881 A 12/2000 Arnett et al.
D438,169 S 2/2001 Minagawa et al.
6,186,834 B1 2/2001 Arnett et al.
6,186,836 B1 2/2001 Ezawa
6,213,808 B1 4/2001 Whatmore
6,226,622 B1 5/2001 Dabbiere
6,231,397 B1 5/2001 de la Borbolla et al.
6,237,051 B1 5/2001 Collins
6,280,256 B1 8/2001 Belopolsky
6,290,529 B1 9/2001 Tsurumaru et al.
6,290,546 B1 9/2001 Pharney
6,304,436 B1 10/2001 Branch et al.
6,310,888 B1 10/2001 Hamlin
6,339,764 B1 1/2002 Livesay et al.
6,346,010 B1 2/2002 Emplit
6,361,354 B1 3/2002 Viklund
D455,431 S 4/2002 Freitag et al.
6,364,675 B1 4/2002 Brauer
6,366,450 B1 4/2002 Janicek
6,368,144 B2 4/2002 Viklund
6,409,547 B1 6/2002 Reede
D460,761 S 7/2002 Croley
D463,359 S 9/2002 Nawrozki
6,443,777 B1 9/2002 McCurdy et al.
6,454,608 B1 * 9/2002 Kitahara et al. ..... 439/638
D465,223 S 11/2002 Milan
6,476,318 B1 11/2002 Lee
6,483,698 B1 11/2002 Loh
D469,761 S 2/2003 Nussberger
6,523,241 B1 2/2003 Hubert et al.
D473,515 S 4/2003 Salazar et al.
D474,736 S 5/2003 Sagawa
D476,359 S 6/2003 Mittler
6,579,116 B2 6/2003 Brennan et al.
D477,604 S 7/2003 Lin
6,597,577 B1 7/2003 Tang et al.
D480,074 S 9/2003 Tuhkanen
D481,674 S 11/2003 Sade et al.
D487,470 S 3/2004 Cobigo
D491,186 S 6/2004 Arakaki et al.
6,786,743 B2 9/2004 Huang
6,910,911 B2 * 6/2005 Mellott et al. ..... 439/358
6,910,922 B2 6/2005 Haga
D507,794 S 7/2005 Wang
6,957,577 B1 10/2005 Firmin
D524,731 S 7/2006 Navarrez
D525,581 S 7/2006 Rad
D527,712 S 9/2006 Indio da Costa
D543,148 S 5/2007 Suckle
D554,642 S 11/2007 Suwalski et al.
D562,761 S 2/2008 Ueda
D569,848 S 5/2008 Suzuki
D571,289 S 6/2008 Michaeli
D572,230 S 7/2008 Neu et al.
7,442,060 B2 * 10/2008 Suwalski et al. ..... 439/180
D585,896 S 2/2009 Wahl
7,722,377 B2 * 5/2010 Moore ..... 439/341
2005/0095899 A1 5/2005 Mellott et al.
2011/0056723 A1 3/2011 Slippy et al.

FOREIGN PATENT DOCUMENTS

WO 2011116194 A2 9/2011

OTHER PUBLICATIONS

Photographs of Vocollect Talkman T2x Wearable Computer (circa 2002)(2 pages).
International Search Report and Written Opinion mailed Mar. 8, 2011 for International Application No. PCT/US2010/048063 (16 pages).

* cited by examiner

BREAK-AWAY ELECTRICAL CONNECTOR

FIELD OF THE INVENTION

This invention relates generally to connectors and more specifically, to electrical connectors having use with wearable, portable and/or mobile computers and peripheral devices.

BACKGROUND OF THE INVENTION

Wearable, portable and/or mobile computer devices and terminals are used for a wide variety of tasks. Such portable computers allow a worker using them to have mobility, while providing them with desirable computing and data-processing functions. Furthermore, various portable computers provide a communication link to a larger, more centralized computer system and are being implemented for an ever-increasing number of worker and communication tasks.

One illustrative example of a specific use for a wearable or portable computer is voice-directed or voice-assisted work, although the invention will have applicability with a wide variety of uses as will be understood by a person of ordinary skill in the art. Centralized work management systems involve a combination of a central computer system for the work management and data management and storage, a plurality of portable computers that interface with the central system, and the workers and other people who use and interface with the portable computers and central system.

To provide an interface between the central system and the users, the portable computers are worn and used by the users as they complete their numerous tasks. In a voice-based system, the portable computers obtain information directly from the central system and translate the information into voice or text commands for the users. Through wireless links, the commands to the users and responses from the users are communicated between the system and the portable computers. To communicate in a voice-based system, for example, the user wears a headset, which is coupled to their wearable computer. Through the headset, the users are able to receive voice instructions, ask questions, report the progress of their tasks, report working conditions, and provide and capture other data.

In addition to headsets, other peripheral devices are often coupled to the portable computers depending upon the tasks to be performed. For example, bar code readers, RFID readers, and other scanners may be utilized alone or in combination with a headset to communicate back and forth in the system. Although the example of a voice-based system is set forth for illustration, the invention has applicability beyond voice-based applications.

The peripheral devices, such as headsets, are often attached to a portable computer with a cord. For a headset, the cord extends generally from the computer (typically worn on a belt or at the waist area of a user) to the head of the user where the headset is located. With other peripheral devices, such as scanners or readers, the cord may extend from the portable computer at the waist to the hand of the user. As may be appreciated, the users are often moving rapidly around their work area or facility and are in some cases maybe jumping on and off of equipment, such as forklifts, pallet loaders, and other equipment. Therefore, there is always a possibility for a cord to get caught on some object. When this occurs, the cord will tend to want to separate either from the attachment point with the peripheral device or from the attachment point with the portable computer. Generally, the cords are permanently attached to the peripheral, such as a headset, and each user maintains their own headset (e.g. for individual responsibility and/or hygiene purposes). The cords are then plugged into the portable computers. Therefore, the separation will generally occur at the plug or socket of the portable computer.

Attempts have been made to appropriately handle a snagged cord and cord separation. However, there are competing issues that must be addressed. When the cord plug is strongly secured to the portable computer socket, a snagged cord may actually pull the socket out of the computer housing or otherwise damage the socket and computer. This may render the computer inoperable and require repair or replacement. However, strengthening the anchoring point at the socket may lead to the cords actually pulling away from their attachment to the peripheral device, thus damaging the peripheral device.

One example of an attempt to balance and otherwise address these issues is provided in the connector of U.S. Pat. No. 6,910,911, which is owned by the assignee of the current application. However, it is still desirable to further improve upon the connector of the '911 patent. It is also desirable to address separation issues between devices connected by a cord regardless of what direction the break-away or pulling force is applied to the cord and with respect to the plug and socket. It is further desirable to improve the robustness of a connector and cord arrangement for use in dynamic environments where the cords may be pulled and stressed on a somewhat regular basis.

BRIEF DESCRIPTION OF THE DRAWINGS

The accompanying drawings, which are incorporated in and constitute a part of this specification, illustrate embodiments of the invention and, together with a general description of the invention given below, serve to explain the principles of the invention.

DETAILED DESCRIPTION OF THE INVENTION

Although the invention will be described herein in relation to certain embodiments, the invention is not limited to practice in any one specific type of portable or wearable computer or one specific type of peripheral device. It is contemplated that the principles of the invention can be used to connect a variety of electronic devices, including but not limited to wearable, portable and/or mobile computers and headsets and scanners/readers. The description of the invention is intended to cover all alternatives, modifications, and equivalent arrangements as may be included within the spirit and scope of the invention as defined by the appended claims. In particular, those skilled in the art will recognize that the components of the invention described herein could be arranged in multiple different ways.

Figure 1:
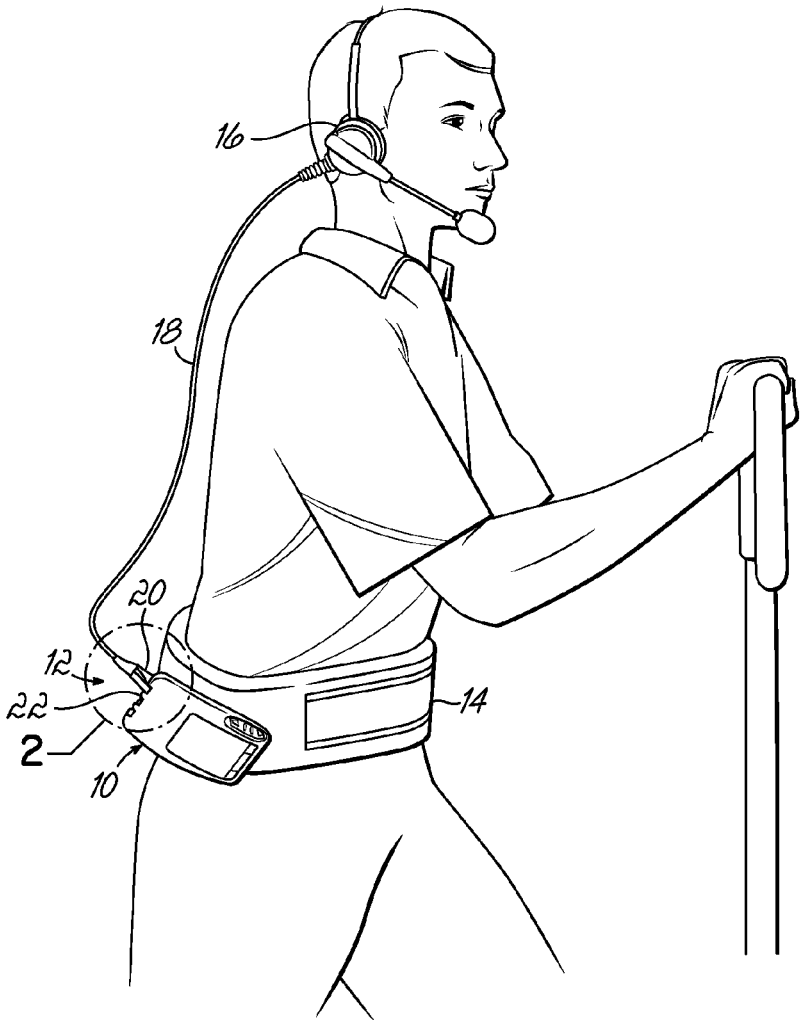
FIG. 1 is an illustration of a portable computer device and peripheral device coupled with a cord and connector of the present invention.

Referring to FIG. 1, there is shown a wearable computer 10 which incorporates a break-away connector 12 of the present invention. While described herein with regard to a wearable computer 10, it will be appreciated that the exemplary connector 12 is generally applicable to electronic devices connected together by a wire or cord. The wearable computer 10 may be worn by a worker on a belt 14 or other support and may be connected to a peripheral device 16, such as a voice headset, by a cord 18. The cord 18 is connected to the headset 16 and is coupled to the computer 10 by a break-away connector 12 in accordance with the principles of the invention. The portable computer 10 and peripheral device 16 permit a user to communicate with a central computer system, or other information system and to send and receive information regarding the activities performed by the user.

In certain uses and environments, the cord 18 connecting the two devices 16, 18 may become snagged or entangled. Therefore, it is desirable to have a connector 12 which provides a secure electrical connection between the device 16 and cord 18 and the computer 10, but which will break away at a specified break-away force whereby the connector becomes uncoupled from the computer 10 to prevent permanent damage to the computer 10, the peripheral device 16 or the cord 18.

While an exemplary embodiment, as illustrated and disclosed herein, shows a peripheral device as a voice headset, other peripheral devices 16 may also be utilized equally with the present invention. For example, bar code readers, scanners, printers and other peripherals which might be coupled to computer 10 through cord 18 will also benefit from the aspects of the present invention.

Figure 2:
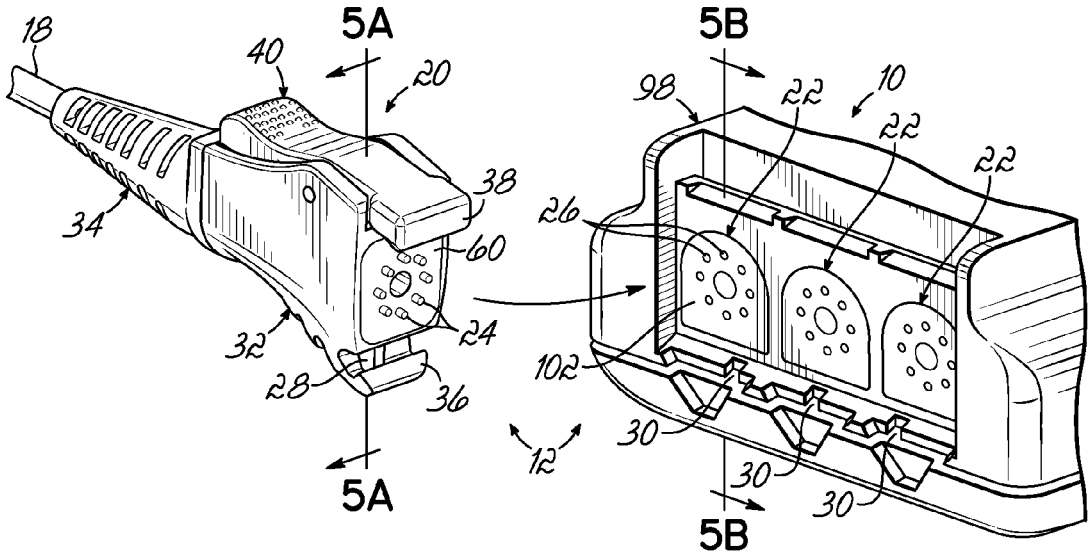
FIG. 2 is an exploded view of the encircled area 2 of FIG. 1, depicting a connector according to an embodiment of the present invention.

FIG. 2 shows detail of the exemplary connector 12 comprising two elements, a plug member 20 and a socket portion 22. The plug member 20 and socket portion 22 are shown uncoupled in FIG. 2 for clarity. Advantageously, plug member 20 may be coupled to socket portion 22 to provide an electric connection between a peripheral device 16 and the portable computer 10 via conductive electrical contacts 24, such as conductive pins, on the plug member 20 and corresponding contacts 26 on the socket portion 22. In the illustrated embodiment, socket portion 22 is illustrated as part of the housing 98 of computer 10. However, socket portion 22 might take other forms and not be part of the housing but still operably coupled thereto.

The computer 10 may have a socket portion 22 for a single connector 12, or may be provided with multiple socket portions 22 for the coupling of multiple plug portions 20, as depicted in FIG. 2. When multiple connectors 12 are used, the plug member 20 and socket portions 22 may be provided with keys 28 and corresponding keyways or key slots 30, respectively, to ensure that the appropriate plug member 20 is coupled to its respective socket portion 22.

Figure 3:
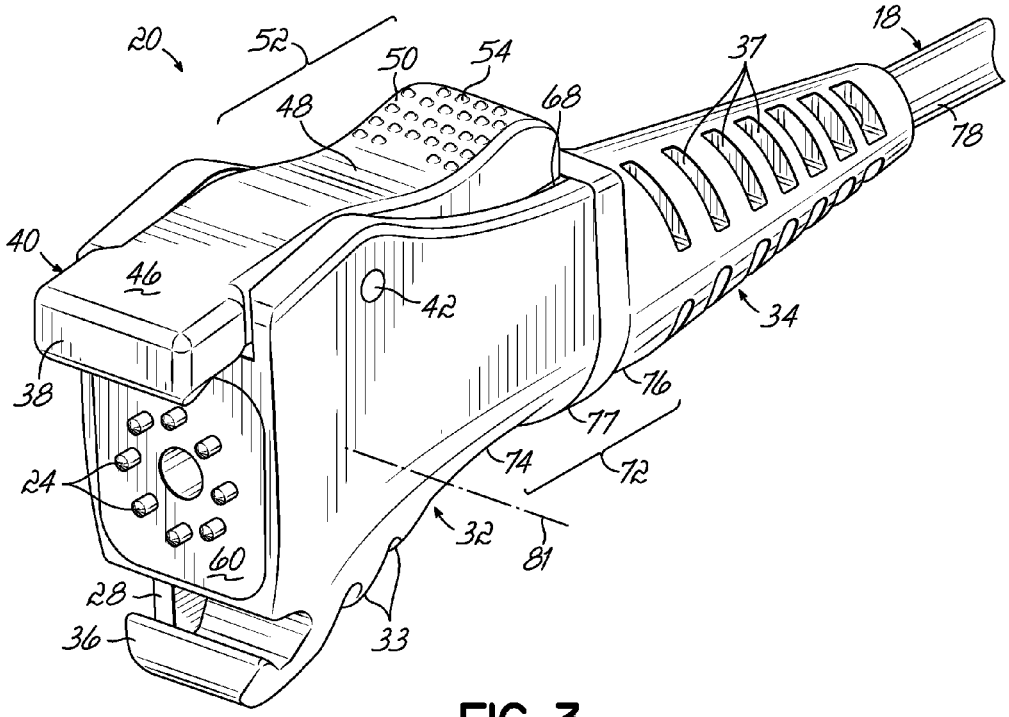
FIG. 3 is a perspective view of the plug member of the connector of FIG. 2.
Figure 4:
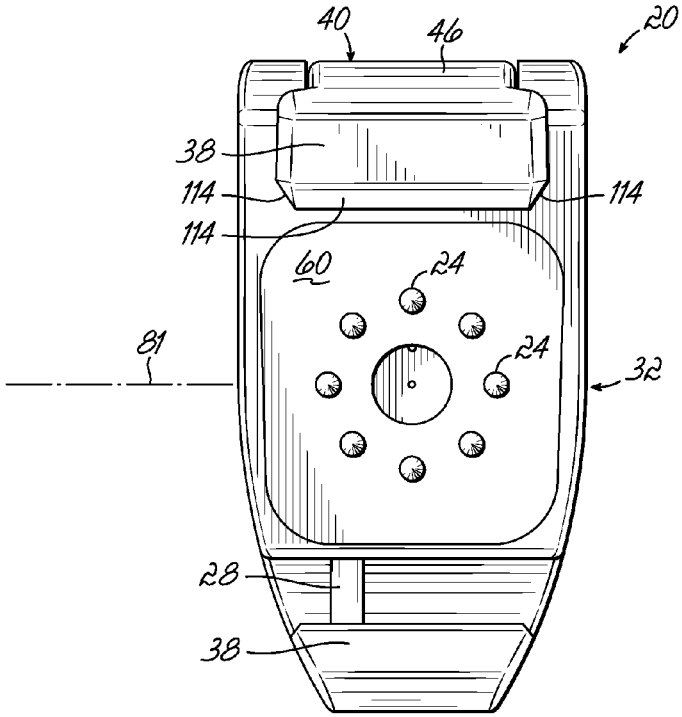
FIG. 4 is a front view of the plug member of the connector of FIG. 2.

FIGS. 3 and 4 illustrate external details of the plug member 20 of the current embodiment. The plug member 20 includes a plug housing 32 which is configured to be attached to an end of a cord or cable 18 having one or more electrical conductors. A strain relief 34 is provided at one end of the plug housing 32 and also couples with cord 18. The strain relief 34 helps to retain the cord 18 with the connector housing 32, and has a generally elongated conical profile to prevent stress damages to the end of the cord 18 when the cord 18 is bent in any direction near the plug housing 32. The plug member 20 further includes first and second engagement claws 36, 38 which are used to secure the plug member 20 to the socket portion 22 in a break-away fashion in accordance with the principles of the present invention. The claims 36, 38 are positioned at opposite sides or ends of the force surface or mating surface 60.

Referring to FIG. 3, the first engagement claw 36 is provided on one part of the plug housing 32 such as by being formed integrally with the housing 32, for example. The second engagement claw 38 is provided on a lever arm 40 which is pivotally mounted by a pin 42 or other axis with the plug housing 32. The second engagement claw 38 is positioned substantially opposite the first engagement claw 36 on the housing 32. As most clearly shown in FIG. 4, the second engagement claw 38 includes chamfered side edges 114 as discussed below. A biasing member or spring 44 disposed between the lever arm 40 and the plug housing 32 applies a biasing force to bias the lever arm 40 in one direction toward a first position for engaging the socket portion 22 of connector 12 when coupled thereto. The lever arm 40 may be pivoted in the opposite direction toward a second position for coupling and uncoupling the plug member 20 and socket portion 22 by pressing down upon the lever arm 40 to rotate the arm 40 about the pin 42 against the force of spring 44.

The lever arm 40 further includes an upper surface 46 that is contoured and includes a generally concave profile portion 48 and a raised rear lever portion 50, as shown in FIG. 3. The concave profile portion 48 and raised rear lever portion 50 together define a first gripping surface 52 in the form of a "bowl" that is configured to receive a user's thumb. The gripping surface 52 is adapted to provide a desirable contour for the thumb of a user as the lever arm 40 is depressed against the biasing force. In the embodiment illustrated, the gripping surface 52 includes a raised surface feature, such as a plurality of raised bumps 54, to further improve a user's grip on the lever arm 40.

Figure 5:
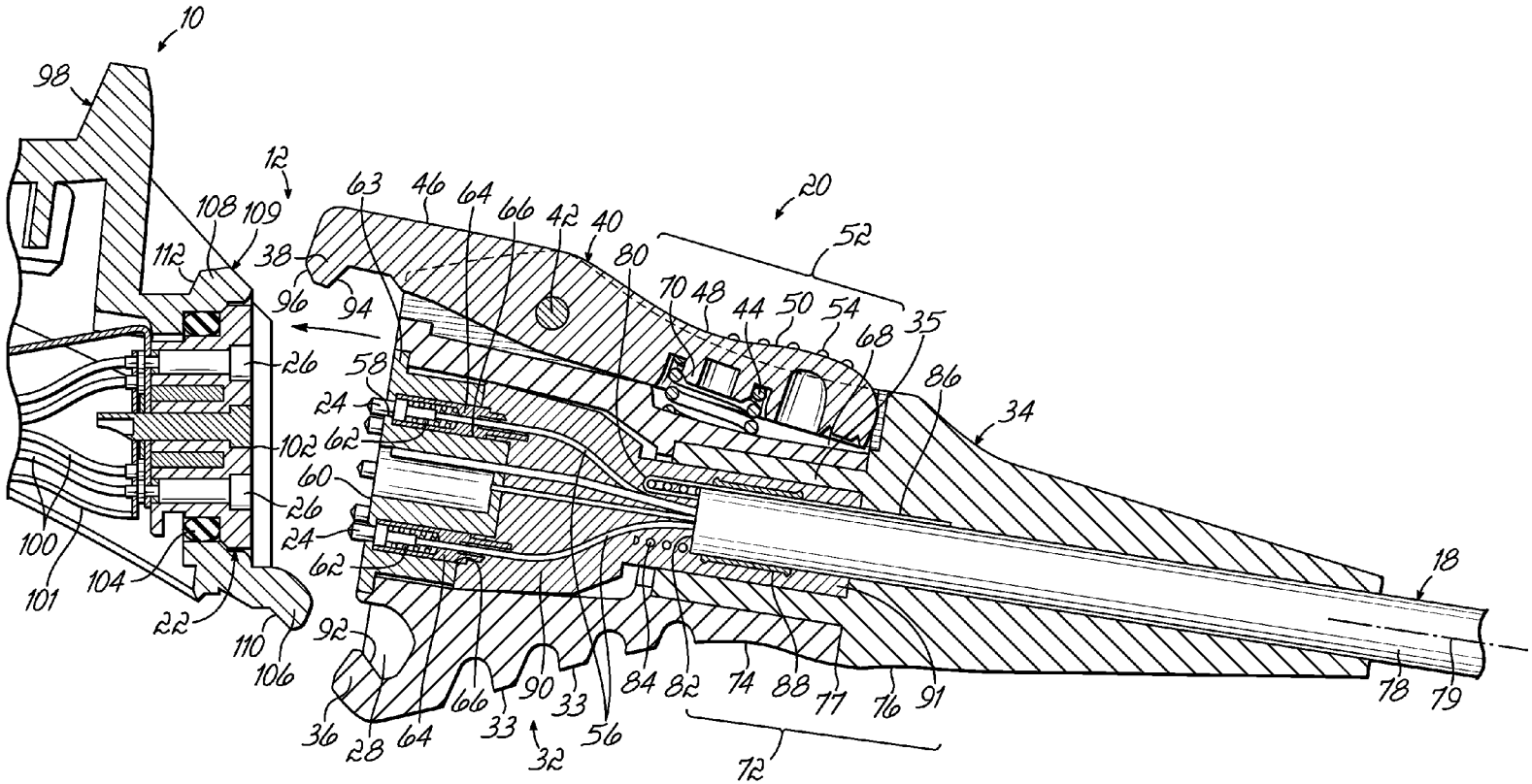
FIG. 5 is a cross-sectional view of the connector taken generally along lines 5A-5A and 5B-5B of FIG. 2, showing the plug member and socket portion completely uncoupled from one another.
Figure 6:
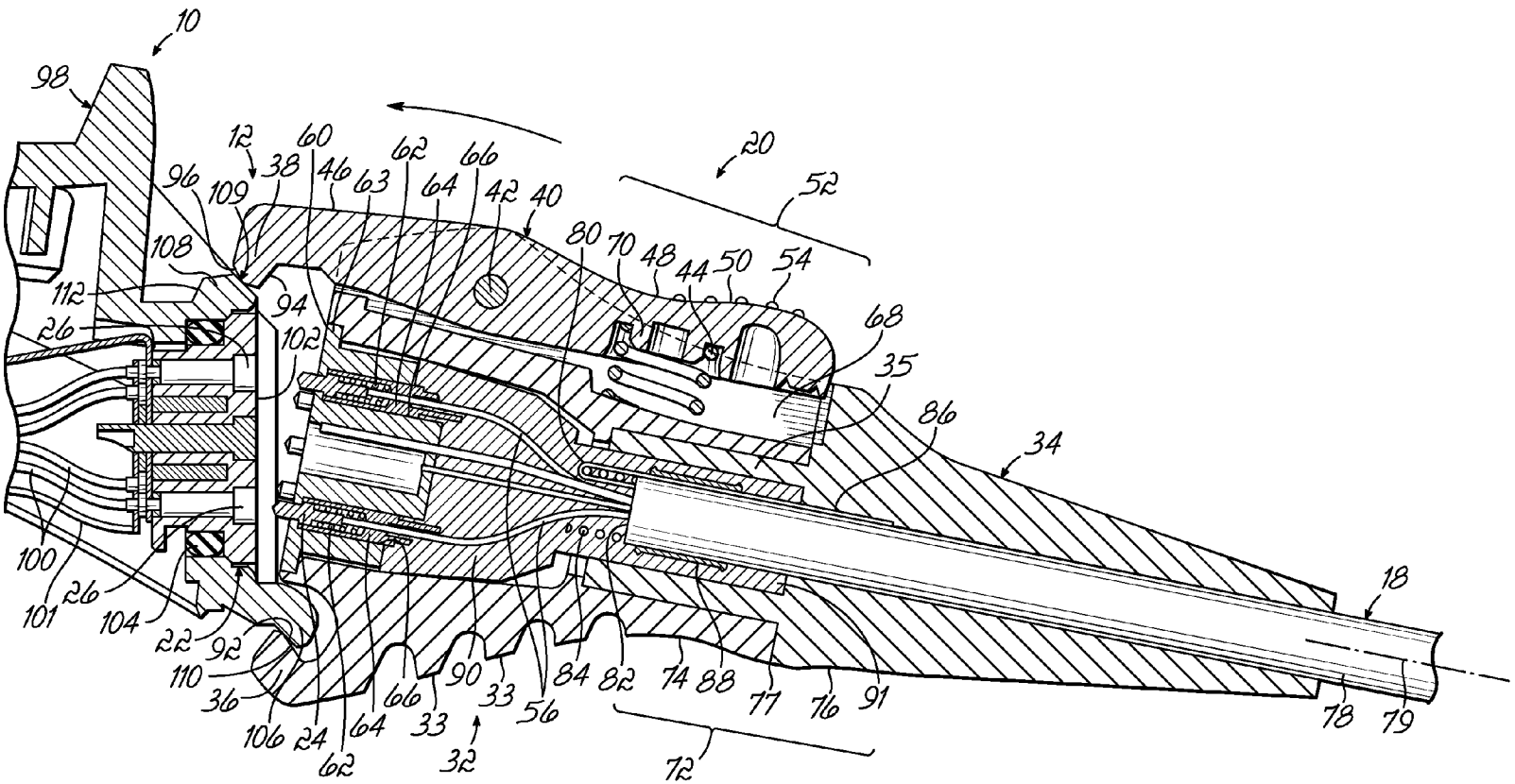
FIG. 6 is a cross-sectional view of the connector of FIG. 5, showing the plug member and socket portion just prior to coupling.
Figure 7:
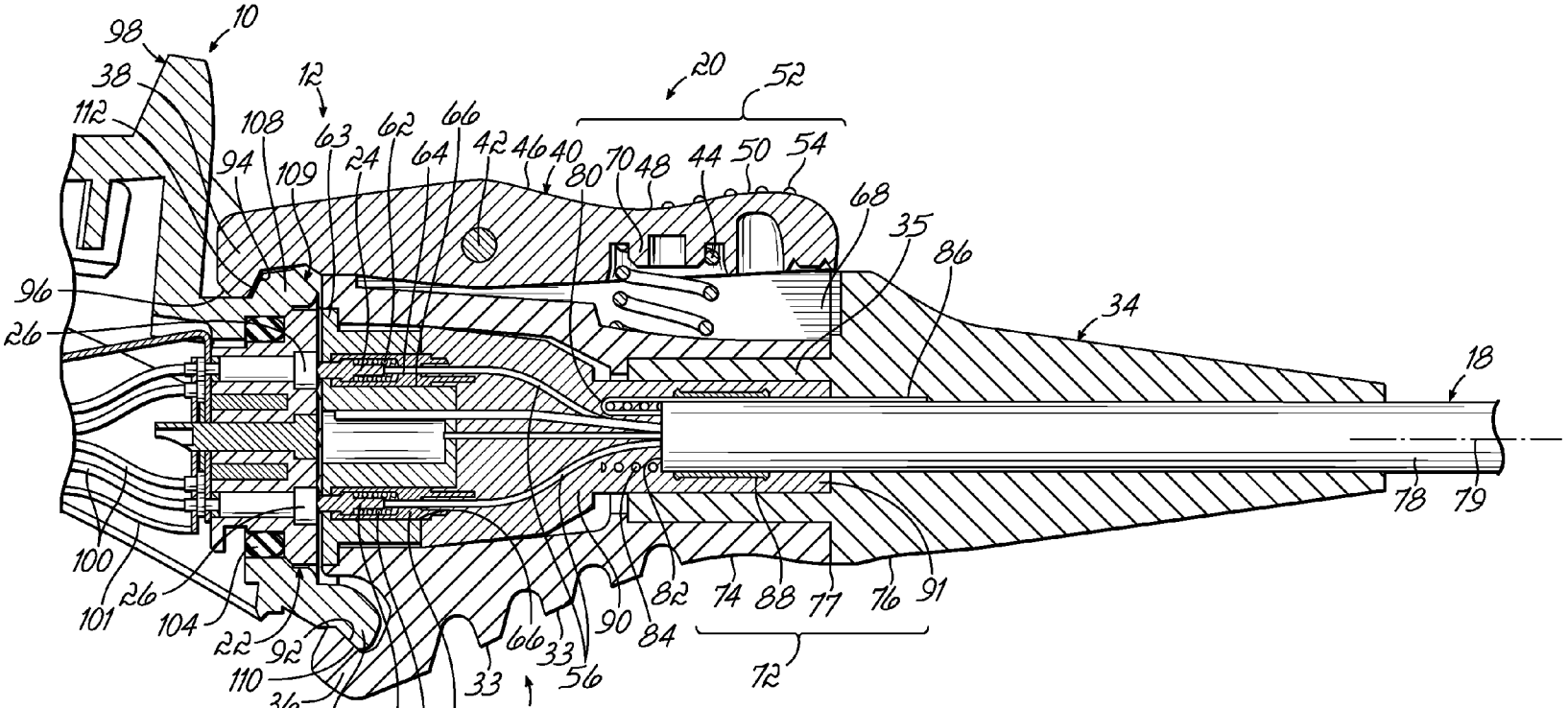
FIG. 7 is a cross-sectional view of a tension member of FIG. 5, showing the plug member and socket portion coupled together.

FIGS. 5-7 show cross-sectional views illustrating additional details of the plug member 20 and socket portion 22 of an exemplary electrical connector 12 of FIG. 2. Individual electrical conductors 56 of the multi-conductor cord 18 terminate and are separated within the plug housing 32 to be electrically coupled with respective electrical contacts 24. In the exemplary plug member 20 shown, the electrical contacts 24 are compressible contacts, such as pogo pin contacts. The contacts 24 protrude through apertures 58 provided in mating surface 60 of the plug member 20. The contacts 24 have respective biasing members or springs 62 that bias the pins 24 in a direction toward the mating surface 60, and which also permit the contacts 24 to be displaced when the plug member 20 couples with the socket portion 22. This insures a robust electrical contact between the plug member and socket portion.

Each contact 24 is provided with an insert 64, such as a solder cup, that is press-fit into a corresponding cavity 66 provided in the plug housing 32. In the illustrated embodiment, a plate structure 63 is press fit into housing 32. The plate structure 63 forms the cavities 66 and defines at least part of the mating surface 60. Each spring 62 is contained in the insert and is compressed between the insert 64 and the respective contact 24 to bias the contact toward mating surface 60.

The insert 64 also electrically couples each conductor 56 of the multi-conductor cord 18 with a corresponding one of the electrical contacts 24. The insert 64 further operates to seal off the junction between each conductor 56 and the corresponding contact 24 to prevent moisture from infiltrating around the contact 24 into the associated cavity 66.

With continued reference to FIGS. 5-7, the plug housing 32 includes a lever cavity 68 adapted to contain the biasing member 44 and the lever arm 40. A protrusion 70 is formed into one end of the lever arm 40 to help retain the biasing member 44 in position on the plug housing 32. When the lever arm 40 is rotated against the biasing force to a position as shown in FIG. 5 so as to engage or disengage the socket portion 22 with the plug member 20, the raised rear lever portion 50 of the concave profile 48 still projects above the height H of lever cavity 68 (See FIG. 3A). This allows a user to maintain a good grip on the first gripping surface 52 at all locations along the lever arm's 40 rotation.

The raised lever portion 50 of the gripping surface 52 provides significant advantages to the plug 20 of the invention. Not only does the raised lever portion 50 create the "bowl" for providing a thumb grip on the plug portion, but that lever portion 50 also provides a tactile feel for the user throughout the travel of the lever arm 40 and the engagement and disengagement of the plug. Even when the lever arm is fully depressed, the thumb of the user is able to stay engaged with gripping surface 52, such as to pull the plug member 20 away from the socket portion or to engage the plug member with the socket portion.

As illustrated in FIGS. 3 and 5-7, the plug member 20 also includes a second gripping surface 72 generally opposite the lever arm 40 and first gripping surface 52. In the embodiment illustrated, the second gripping surface 72 has a contoured profile including a concave surface 74 formed in the plug housing 32 and another concave surface 76 formed in the strain relief 34. The concave surfaces 74, 76 cooperate to form a grip "bump" 77. The concave surfaces 74, 76 and grip bump 77 are adapted to engage a user's fingers comfortably as the user's thumb presses on the first gripping surface 52. This keeps the user's hand in the most efficient position to depress lever arm 40 and disengage or engage the plug member 20 with socket portion 22, thereby making the connector more ergonomic.

The ergonomic design encourages manual actuation of the lever arm 40 for removing or unplugging the plug member 20 instead of breaking the connection between the plug member 20 and the socket portion 22 with a break-away force on the cord 18. The second gripping surface 72 may also include raised bumps 54 like the first gripping surface 52 to increase the grip friction and ensure a proper grip. Although the illustrated embodiment shows the strain relief 34 and housing 32 forming the grip bump 77, the grip bump 77 might also be completely formed on the housing.

Figure 3A:
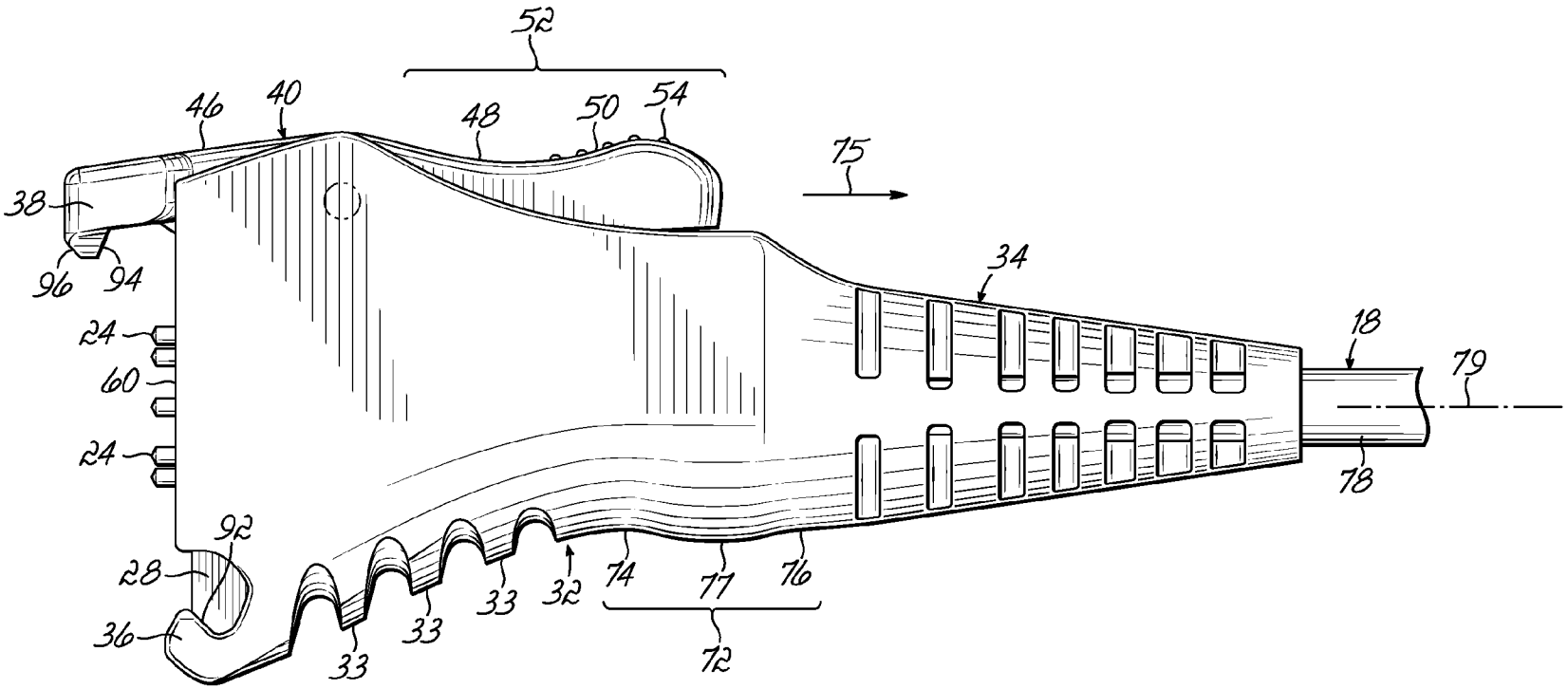
FIG. 3A is a side view of the plug member of the connector of FIG. 2.

The unique combination of the lever arm 40 defining the first gripping surface 52 and the opposing second gripping surface 72 provides an additional benefit in the invention when the plug member 20 is disengaged or unplugged from the socket portion 22. Particularly, the opposing bowl formed in the lever arm and grip bump 77 formed in the second gripping surface 72 creates a rearward force upon the plug member when the lever arm 40 is depressed. Referring to FIG. 3A, squeezing plug member 20 to deflect lever arm 40 to the second portion provides a force at the concave portion 48 and raised rear lever portion 50 and also at concave surface 74 and grip bump 77 thus creating a rearward force in the direction of arrow 75 in FIG. 3A to direct the plug member 20 away from socket portion 22. This further facilitates a more efficient removal or unplugging of the plug member 20. To further facilitate an efficient grip of the plug member 20, the plug housing 32 also includes ridges 33 formed therein, as seen in FIG. 3A.

Figure 8:
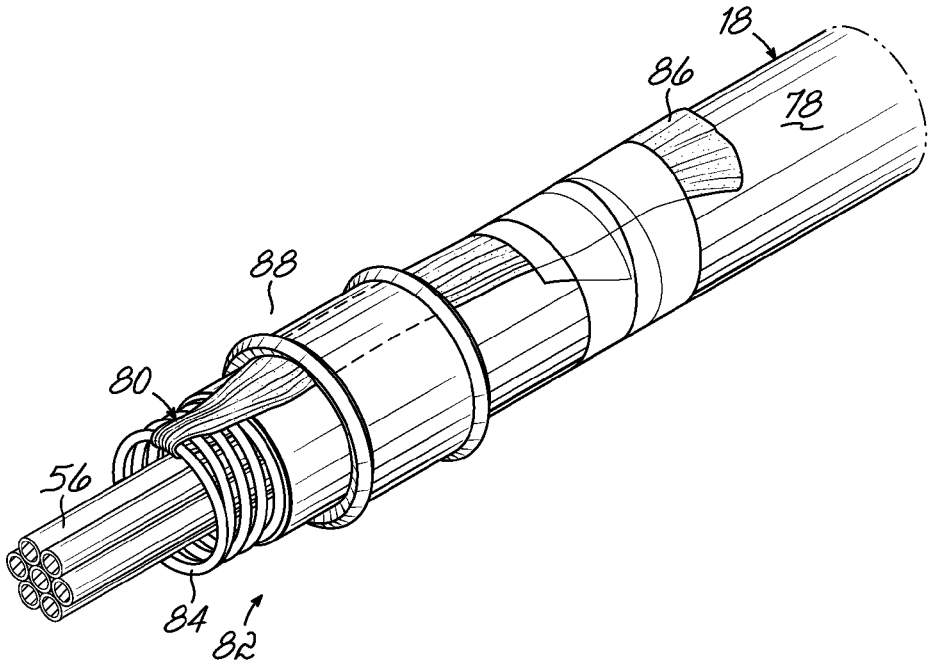
FIG. 8 is a perspective view of the strain relief of the connector of FIG. 2.

With continued reference to FIGS. 5-7 as well as FIG. 8, details of the strain relief 34 are provided. The cord 18 of the peripheral device 16 includes at least one outer insulation layer 78 surrounding and containing the individual conductors 56 and at least one tension member 80. The tension member 80, which might be a Kevlar tension member, for example, is configured to absorb tension placed on the cable or cord 18 in order to protect the conductors 56.

In accordance with one aspect of the invention, the tension member 80 is incorporated into the plug member so that significant tension on the cord 18 at the plug member is transferred to the tension member 80. In particular, the tension member 80 is secured with the plug member, and particularly with an element of the plug member at the end where the cord 18 terminates into the plug member 20. In one embodiment of the invention, an end of the tension member 80 is drawn out of the terminal end of cord 18, and out of an end of the insulation layer 78, and is secured to that terminal end. Furthermore, the tension member 80 is biased when it is connected with the plug member in order to ensure that the tension member is properly tensioned and will absorb the tension forces on cord 18. To that end, the tension member 80 is exposed with the individual conductors when terminating the cord.

Referring to FIG. 8, one end of the cord 18 is stripped of the insulation layer 78 in order to make the previously discussed connections between the individual conductors 56 and the electrical contacts 24 in the plug member 20. The insulation layer 78 may actually be one or more layers, and layer 78 is discussed as the outermost layer. The insulation layer(s) of cord 18 are stripped at the terminal end of cord 18 to expose the conductors 56 and tension member 80. A tensioning element, such as a coil spring 84 for example, may be positioned to engage the end 82 of the cord so that the conductors 56 and tension member 80 pass therethrough as seen in FIG. 8. The exposed end 86 of the tension member 80 extends through the coil spring 84 and is then reversed and pulled back along the cord 18, partially compressing the coil spring 84 and tensioning the tension member 80. The pre-tensioned tension member 80 is then secured to the end 82 of the cord 18 so that a pre-mold portion 90 of plug member 20 may be molded onto end 82 to further secure the cord in the plug member. A securing element 88 secures the end of the tension member. In the illustrated embodiment as show in FIG. 8, a crimping member such as a ring 88 is rigidly coupled around the cord 18, and over the exposed pre-tensioned section of the tension member 80. Preferably, prior to crimping to the ring 88 or otherwise securing the end of tension member 80 to cord end 82, the spring 84 is compressed to maintain the tension on the tension member 80. The pre-mold portion 90 is then molded over the end of the tension member, over the coil spring 84, over crimping member 88, and over cord 18 as illustrated in FIGS. 5-7. The tension maintained by the compressed coil spring 84 and crimping member 88 on the tension member 80 ensures that the tension member 80 is the first member within the cord 18 to experience tension forces when the cord 18 is stretched or pulled or catches on an external structure. Thus, the likelihood of damage to the individual conductors 56 is reduced significantly by the plug member of the invention.

Connector 12 incorporates a strain relief element 34, as noted above. In the illustrated embodiment, the strain relief is over molded onto cord 18 at the back end of the plug housing, as illustrated in FIG. 5-7. Specifically, the strain relief portion 34 has a flange section 35 that extends into the back end of the housing 32 to engage both the housing as well as a rear portion 91 of the pre-mold portion 90. In that way, the strain relief 34 is secured as part of the plug member 20. In the illustrated embodiment, the strain relief is generally conical, as it tapers back to the cord 18. As discussed above, in the illustrated embodiment, the strain relief portion 34 forms part of the grip bump 77 to make up a section of the second gripping surface 72. The strain relief portion 34 also closes the end of lever cavity 68 to contain the lever arm 40 at its rearward edge (FIGS. 5-7). As illustrated in FIG. 3, strain relief portion 34 includes a plurality of slots 37 to allow bending in various directions when cord 18 is bent with respect to plug member 20.

The first and second engagement claws 36, 38 have angled surfaces 92, 94, 114, which facilitate coupling and uncoupling the plug member 20 with the socket portion 22.

In accordance with one aspect of the invention, the plug member 20 incorporates angled surfaces both along a following edge of the engagement claw 38 and the side edges of the claw 38 as well. For example, referring to FIGS. 9 and 10, the engagement claw portion 38 of lever arm 40 includes angled surface 94 along the following edge of the claw, and includes angled surfaces 114 on either side. The cooperating edges provide a significant advantage in the break-away of the plug member 20 from the socket portion 22 in usage. As discussed further hereinbelow, the combination of angle surface 94 and the side angled surfaces 114 facilitate the ability of the plug member 20 to properly break away when a force is applied generally along the axis 79 of the cord, as illustrated in FIGS. 5-7, or when a force is applied from the side of the plug member angled from axis 79, such as shown by arrow 81 in FIG. 3. In use, the inventors have found that significant break-away forces are often not applied to the cord 18 and plug member 20 cleanly along the axis 79 of the cord. Often, such forces are applied at an angle to the plug and cord axis 79. Furthermore, users of plugs along the lines of the invention will often apply a force to the side of the plug member in order to break it away from the socket portion or "snap" the plug member from the socket portion. As discussed below, the side surfaces 114 are then positioned to engage and ride up the angled surface 112, which is provided by the socket portion 22 of the inventive connector.

The second engagement claw 38 on lever arm 40 has a leading edge 96 which is angled to facilitate coupling the plug member 20 with the socket portion 22. Contact between a leading edge angled surface 96 of the claw 38 and an angled surface 109 on an engagement lip 108 on the socket portion 22 urges lever arm 40 from its downward most position or a first position toward the upward or second position, against the opposing bias force created on lever arm 40 by spring 44. The angled surfaces 92, 94, 114 permit the plug member 20 to become uncoupled from the socket portion 22 in a desired "break-away" fashion when a specified force is applied to the plug member 20, as will be described more fully below.

With continued reference to FIGS. 5-7, the socket portion 22 of the electrical connector 12 is shown as part of a device housing 98 to secure the socket portion. As may be appreciated, the device housing 98 might contain the electronics of a personal computer or some other electronic device that operably interfaces with a peripheral device coupled to cord 18 and plug member 20 in a connected fashion. The housing 98 may be connected to, or formed integrally with the housing of such a device. One or more conductors 100 might be routed to the socket portion 22 to be attached to electrical contacts 26 that are configured to mate with corresponding electrical contacts 24 of the plug member 20. Alternatively, a flex circuit 101 might be coupled to the contacts 26 and connected to other device circuitry (not shown). Therefore, the contacts 26 are arranged generally in the same fashion as the contacts 24 as seen in FIG. 2. In the exemplary electrical connector 12 shown, the terminal contacts 26 have flat ends which protrude just above, but generally flush with, a mating surface 102 of the socket portion 22 (as opposed to the upraised pins 24), which is configured to interface with the mating surface 60 of the plug member 20.

As shown in FIGS. 6 and 7, the contacts 26 are configured to mate with the contacts 24 of the plug member 20 when the plug member 20 is coupled to the socket portion 22. An O-ring 104 might be positioned inside the housing 98 to seal the interior of the housing 98 to protect the conductor-contact interface against moisture infiltration. While the contacts 24, 26 shown in the exemplary embodiment are pogo pins and flat contacts configured to mate with the pogo pins, it will be understood that the contacts 24, 26 may be of various other configurations as are known in the art for electrical connectors.

As shown in FIGS. 5-7 and 9, the housing 98 further includes first and second engagement lips 106, 108 which are configured to mate with the first and second engagement claws 36, 38 of the plug member 20 when the plug member 20 is coupled to the socket portion 22. The first and second engagement lips 106, 108 have angled surfaces 110, 112, 109. The angled surfaces 110, 112 correspond to the angled surfaces 92, 94 of the first and second engagement claws 36, 38, respectively. The contact between the first and second engagement claws 36, 38 and first and second engagement lips 106,108 retains the plug member 20 in or on the socket portion 22, as shown in FIG. 7. When the plug member 20 and the socket portion 22 are coupled together, the mating surfaces 60, 102 of the plug member 20 and socket portion 22 interface with one another such that the contacts 24 on the plug member 20 and the contacts 26 on the socket portion 22 are in full contact.

Figure 9:
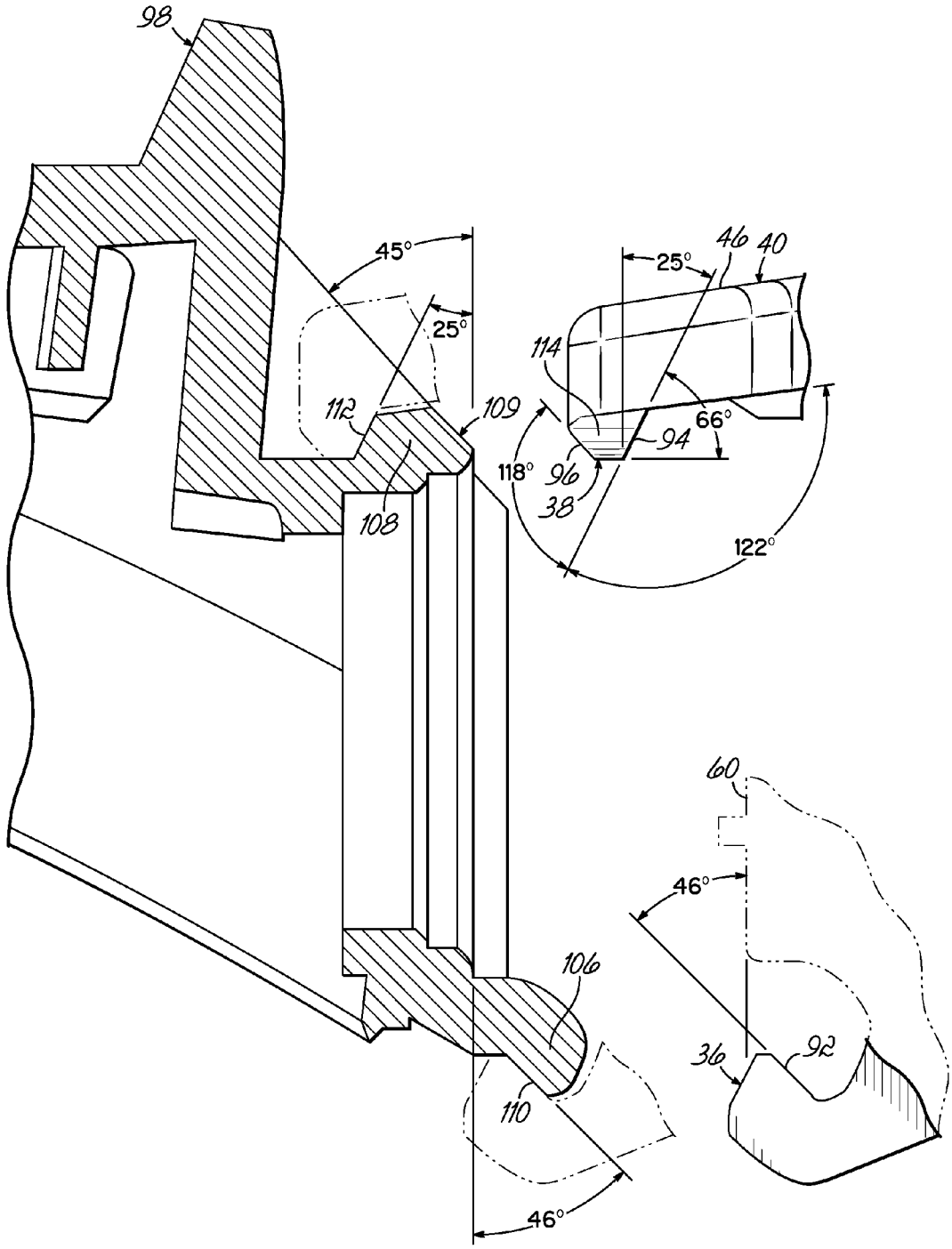
FIG. 9 is a side view showing exemplary dimensions of the terminal housing in cross-section and the engagement claws in elevation.

Referring to FIGS. 6 and 9, a forward angled surface 109 of engagement lip 108 facilities coupling of the plug member with the socket portion. As the plug member is pushed toward the socket portion, angled surface 96 of the engagement claw 38 is directed against angled surface 109. Based upon the force of the plug member, the angled surface 96 rides up the angled surface 109 thus flexing the lever arm against the bias of biasing member 44. When the lever arm has been deflected sufficiently, the engagement claw 38 slides over lip 108 such that the rear angled surface 94 on engagement claw 38 engages the angled surface 112 of lip 108.

Advantageously, the angled surfaces 92, 94, 110, 112, 114 on the first and second engagement claws 36, 38 and on the corresponding first and second engagement lips 106, 108 act in cooperation with the biasing member 44 on the plug member 20 to allow the plug member 20 to appropriately break away from the socket portion 22 when force of a specific magnitude is applied to the plug member 20. This force may be applied to the plug member 20 through the cord 18 connected to the plug housing 32, such as when the cord 18 becomes snagged on an object or machine, or might be applied directly to the housing 32 of the plug member. Accordingly, the angled surfaces 92, 94, 110, 112, 114 on the first and second engagement claws 36, 38 and the first and second engagement lips 106, 108 may be selected, in conjunction with a given biasing force, such as a spring constant or spring biasing member 44 to permit the plug member 20 to break away from the socket portion 22 at a predetermined break-away force. As noted earlier, the second engagement claw 38 includes chamfered side edges that form angled surfaces 114 at the sides of the angled surface 94, which allows the same break-away force to be applied to the plug member 20 in any direction, such as normal to the mating surface 60 (arrow 75 of FIGS. 3-4), tangential to the mating surface 60 (arrow 81 of FIGS. 3-4), or generally any angular direction therebetween. In other words, the angled surfaces 114 of the chamfered side edges and the angled surface 94 are configured to begin sliding along angled surface 112 of the second engagement lip 108 at a certain break-away force, regardless of the specific direction of the break-away force.

This provides a significant advantage to the present invention. For example, the angled side surfaces 114 in combination with surface 94 allow the plug to be pulled in any particular direction to facilitate a clean break away of the plug member 20 from the socket portion 22.

When the force applied to plug member 20 reaches the predetermined break-away force value, lever arm 40 is caused to rotate or deflect about pin 42 from the first position (FIG. 7) toward the second position (FIGS. 5 and 6), whereby plug member 20 may become uncoupled from socket portion 22.

Advantageously, the break-away force may be specified such that the plug member 20 will remain coupled to the socket portion 22 during normal operation of the computer 10. The plug member 20 then uncouples from the socket portion 22 when the force applied to the plug member 20 directly or through the cord 18 reaches the specified break-away force to thereby prevent damage to the electrical connector 12, or to prevent hindering the user of device 10. For example, the orientation of the angled surfaces 92, 94, 110, 112, 114 and the spring constant of bias spring 44 may be selected such that the break-away force is approximately equal to a force at which cord 18 has been rated to operate without sustaining damage, multiplied by a design factor.

Generally, the maximum rated load or force for which the cord 18 may operate without failing is specified by the manufacturer of the cord. A derating factor generally has a value less than 1 and is applied to the rated force to account for variations in material properties, the number of loadings which may be experienced by the cord, aging of the cord, and other considerations which add uncertainty to the determination of a precise load rating for the cord. In an exemplary embodiment, cord 18 may fail at about 100 pounds and the derating factor is selected to range from about 0.04 to about 0.08, whereby the desired break-away force is about 5 pounds. The break-away force may be at least 4%-5% of the rated failure load of the cord.

Figure 10:
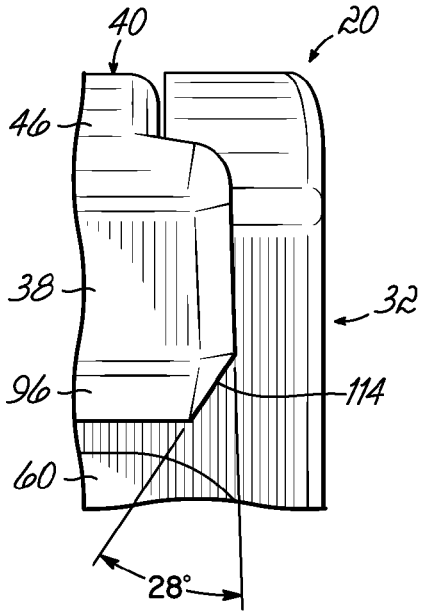
FIG. 10 is a front view showing exemplary dimensions of the of the second engagement claw in elevation.

With reference to FIGS. 9 and 10 in an exemplary embodiment, the first engagement claw 36 has an angled surface 92 oriented approximately 46° from the plane of the mating surface 60 of the plug member 20 that corresponds to surface 110 at a similar angle to the plane of the mating surface (FIG. 9). The second engagement claw 38 has an angled surface 94 oriented approximately 25° from the plane of the mating surface 60 of the plug member 20 when the lever arm 40 is in the first position, as depicted by phantom lines in FIG. 9. Surface 94 corresponds to surface 112 at a similar angle to the plane of the mating surface (FIG. 9). In the exemplary embodiment, the 25° angle of the surface 94 of second engagement claw 38 corresponds to an angle of approximately 122° from a surface which is parallel to a longitudinal axis of lever arm 40, as shown in FIG. 9. The socket portion 22 of the exemplary embodiment has first and second engagement lips 106, 108 with angled surfaces 110, 112 oriented at approximately 46° and 25°, respectively, from the plane of the mating surface 102 of the socket portion 22. Surface 109 on the leading edge of lip 108 is oriented at an angle of approximately 45° from the plane of face surface 102 shown in FIG. 9. When the spring constant of the spring 44 is 79.5 lb/in., the break-away force of the exemplary electrical connector 12 is in the range of approximately 8 to 12 pounds or more specifically 4 to 6 pounds. Of course, other selected break-away force ranges may be used, such as by varying the biasing force or spring force of biasing member 44 or the angles of the respective angled surfaces 92, 94, 110, 112 on the engagement claws 36, 38 and lips 106, 108. Generally, the break-away force may range from about 3 pounds to about 15 pounds without departing from the spirit and scope of the invention. In the exemplary embodiment, leading edge angled surface 96 is angled approximately 118° from the plane of the angled surface 94 of second engagement claw 38, as depicted in FIG. 9. Referring to FIG. 10, the chamfered side edges provide surfaces 114 that are angled at approximately 28° from a side edge plane of the second engagement claw 38.

The plug housing 32, housing 98, lever arm 40 and strain relief may be formed from polymeric material. In an exemplary embodiment, the plug housing 32, housing 98, and lever arm 40 are formed from Xenoy 5220u, a thermoplastic resin available from SABIC, Seven Hills, Ohio. This polymer has good low temperature characteristics useful when the connector 12 is exposed to low temperatures. The strain relief in an exemplary embodiment is formed of polyurethane resin (BFG Estane 58881).

With reference to FIGS. 5-7, coupling of the plug member 20 with the socket portion 22 will be described. In use, the connector 12 of the present invention may be used to couple a peripheral device 16, such as a headset, to a portable computer 10 or other device. A user depresses lever arm 40 at the gripping surface 52 to pivot or deflect the arm 40 toward the second position and brings the first engagement claw 36 on the plug member 20 into engagement with the first engagement lip 106 on the socket portion 22 (FIGS. 5 and 6). The corresponding keys 28 and keyways 30 will ensure that the proper plug member 20 is coupled with the proper socket portion 22. The user then urges the second engagement claw 38 into engagement with second engagement lip 108, whereby the angled surface 96 of the second engagement claw 38 facilitates engagement of the claw 38 with second engagement lip 108 (FIG. 6). Mating surfaces 60, 102 are brought into substantially abutting relation and contacts 24, 26 are in full contact with one another. The plug member 20 and socket portion 22 are fully coupled and the user may then release lever arm 40 (FIG. 7). Advantageously, the connector 12 securely couples peripheral 16 to computer 10 during normal activities of the worker. However, if cord 18 should become snagged on an object or the plug member 20 is pushed on or pulled, the plug member 20 will become uncoupled from socket portion 22 when the force applied to plug member 20 either directly or through cord 18 reaches the specific break-away force. This thereby prevents damage to computer 10, connector 12 or cord 18 while allowing a clean break-away for the user. The connector 12 may then be easily coupled or re-secured with the computer 10 for further use.

While the present invention has been illustrated by the description of the embodiments thereof and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A connector comprising:

a plug member and a socket portion configured for mating with the plug member;

the plug member including a first engagement claw having a first angled surface positioned to engage a first complementary angled surface associated with the socket portion;

a lever arm pivotally mounted on the plug member and movable between a first position for coupling the plug member to the socket portion and a second position for uncoupling the plug member from the socket portion, the lever arm including a second engagement claw having a second angled surface configured to engage a second complementary angled surface associated with the socket portion when said lever arm is in said first position;

the lever arm including a first gripping surface having a concave profile portion and raised rear lever portion proximate the concave profile portion, a second gripping surface formed in the plug member generally opposite the lever arm and first gripping surface, the second gripping surface including at least one concave surface and a raised grip bump located rearwardly of the at least one concave surface for engaging a user's fingers when the lever arm is manually actuated;

the first gripping surface concave profile portion and second gripping surface concave surface cooperating to create a rearward force to direct the plug member away from the socket portion when the plug member is squeezed and lever arm moved to the second position;

a biasing member disposed between said plug member and said lever arm for biasing said lever arm toward said first position with a biasing force, the plug portion further being adapted to uncouple from the socket portion when a break-away force is applied to the plug member to cause said second angled surface to slide over the second complementary angled surface of the terminal connector associated with the socket portion by overcoming the biasing force.

2. The connector of claim 1 wherein the second gripping surface includes multiple concave surfaces positioned on either side of the grip bump for engaging a user's fingers when the lever arm is manually actuated.

3. The connector of claim 1, wherein at least one of the said first gripping surface and said second gripping surface include raised bumps on the respective surface configured to improve a user's grip on the connector.

4. The connector of claim 1 wherein the plug member includes a plug housing with a cavity to contain the lever arm, the raised rear lever portion being configured to project beyond said cavity in said plug housing when said lever arm is in the second position.

5. The connector of claim 1, wherein said second engagement claw includes chamfered side edges with angled surfaces that are configured to allow said second angled surface to slide over the second complementary angled surface associated with the socket portion when the break-away force is applied to the connector.

6. The connector of claim 1, wherein said connector is configured to uncouple from the socket portion when a magnitude of the break-away force is at least 4%-5% of the rated failure load of the cord coupled to the peripheral device.

7. The connector of claim 1, wherein said connector is configured to uncouple from the socket portion when a magnitude of the break-away force is between about 3 pounds and about 15 pounds.

8. A connector comprising:

a plug member and a socket portion configured for mating with the plug member;

the plug member including a first engagement claw having a first angled surface positioned to engage a first complementary angled surface associated with the socket portion;

a lever arm pivotally mounted on the plug member and movable between a first position for coupling the plug member to the socket portion and a second position for uncoupling the plug member from the socket portion, the lever arm including a second engagement claw having a second angled surface configured to engage a second complementary angled surface associated with the socket portion when said lever arm is in said first position;

the second engagement claw also including a chamfered side edges that form angled surfaces on both sides of the second angled surface to provide angled surfaces around the second engagement claw where it engages the complementary second angled surface associated with the socket portion;

a biasing member disposed between said plug member and said lever arm for biasing said lever arm toward said first position with a biasing force;

the plug portion being adapted to uncouple from the socket portion when a break-away force is applied to the plug member to cause said second angled surface, an angled surface of the chamfered side edge, or a combination of those angled surfaces to slide over the second complementary angled surface associated with the socket portion by overcoming the biasing force.

9. The connector of claim 8, wherein said connector is configured to uncouple from the socket portion when a magnitude of the break-away force is at least 4%-5% of a rated failure load of the cord coupled to the peripheral device.

10. The connector of claim 8, wherein said connector is configured to uncouple from the socket portion when a magnitude of the break-away force is between about 3 pounds and about 15 pounds.

11. The connector of claim 8, wherein the angled surface of the chamfered side edge is angled approximately 28° from said second angled surface.

12. The connector of claim 8 further comprising chamfered side edges on both sides of the second angled surface to form angled surfaces at the sides of the second angled surface.

13. A connector comprising:

a plug member configured for mating with a socket portion and including a first engagement claw having a first angled surface positioned to engage an angled surface associated with the socket portion;

a lever arm pivotally mounted on the plug member and movable between a first position for coupling the plug member to a socket portion and a second position for uncoupling the plug member from the socket portion, the lever arm including a second engagement claw having a second angled surface configured to engage another angled surface associated with the socket portion when said lever arm is in said first position;

the lever arm including a first gripping surface having a concave profile portion and raised rear lever portion proximate the concave profile portion;

a second gripping surface formed in the plug member generally opposite the lever arm and first gripping surface, the second gripping surface including at least one concave surface and a raised grip bump located rearwardly of the at least one concave surface for engaging a user's fingers when the lever arm is manually actuated;

the first gripping surface concave profile portion and second gripping surface concave surface cooperating to create a rearward force to direct the plug member away from the socket portion when the plug member is squeezed and lever arm moved to the second position;

a biasing member disposed between said plug member and said lever arm for biasing said lever arm toward said first position with a biasing force;

the plug portion further being adapted to uncouple from the socket portion when a break-away force is applied to the plug member to cause said second angled surface to slide over the another angled surface associated with the socket portion by overcoming the biasing force.

14. The connector of claim 13 wherein the second gripping surface includes multiple concave surfaces positioned on either side of the grip bump for engaging a user's fingers when the lever arm is manually actuated.

15. The connector of claim 13 wherein at least one of the said first gripping surface and said second gripping surface include raised bumps on the respective surface configured to improve a user's grip on the connector.

16. The connector of claim 13, wherein said second engagement claw includes chamfered side edges with angled surfaces that are configured to allow said second angled surface to slide over the another angled surface associated with the socket portion when the break-away force is applied to the connector.

17. The connector of claim 13, wherein said connector is configured to uncouple from the socket portion when a magnitude of the break-away force is at least 4%-5% of the rated failure load of the cord coupled to the peripheral device.

18. The connector of claim 13, wherein said connector is configured to uncouple from the socket portion when a magnitude of the break-away force is between about 3 pounds and about 15 pounds.

* * * * *

UNITED STATES PATENT AND TRADEMARK OFFICE

CERTIFICATE OF CORRECTION

PATENT NO. : 8,262,403 B2
APPLICATION NO. : 12/557011
DATED : September 11, 2012
INVENTOR(S) : Gordon Slippy et al.

It is certified that error appears in the above-identified patent and that said Letters Patent is hereby corrected as shown below:

In the Specifications

In Column 2, Lines 61-62 reads ". . . dimensions of the of the second. . ." and should read -- . . . dimensions of the second . . . --.

In Column 6, Line 67 reads ". . . illustrated in FIG. 5-7 . . ." and should read -- . . . illustrated in FIGS. 5-7 . . . --.

In Column 7, Lines 27-28 reads ". . . the combination of angle surface 94 and the side angled surfaces 114 facilitate . . ." and should read -- . . . the combination of angle surface 94 and the side angled surfaces 114 facilitates . . . --.

In Column 10, Line 61 reads ". . . intention of the applicant to . . ." and should read -- . . . intention of the applicants to . . . --.

In Column 10, Line 65 reads ". . . not limited to the specific details representative apparatus and method, and . . ." and should read -- . . . not limited to the specific details, representative apparatus and method, and . . . --.

In Column 11, Lines 1-2 reads ". . . spirit or scope of applicant's general . . ." and should read -- . . . spirit or scope of applicants' general . . . --.

In the Claims

In Column 12, Lines 21-22, CLAIM 8 reads ". . . including a chamfered side edges that. . ." and should read -- . . . including chamfered side edges that . . . --.

Signed and Sealed this
Fourth Day of February, 2014

Michelle K. Lee

Michelle K. Lee
*Deputy Director of the United States Patent and Trademark Office*